US006394018B1

(12) United States Patent
Klimenko

(10) Patent No.: US 6,394,018 B1
(45) Date of Patent: May 28, 2002

(54) INFLATABLE DEFLECTOR

(75) Inventor: Konstantin Klimenko, Los Angeles, CA (US)

(73) Assignee: Sevylor U.S.A., Inc., Los Angeles, CA (US)

( * ) Notice: Subject to any disclaimer, the term of this patent is extended or adjusted under 35 U.S.C. 154(b) by 0 days.

(21) Appl. No.: 09/904,008

(22) Filed: Jul. 12, 2001

Related U.S. Application Data

(63) Continuation of application No. 09/640,324, filed on Aug. 16, 2000.
(60) Provisional application No. 60/149,154, filed on Aug. 16, 1999.

(51) Int. Cl.[7] ..... B63B 7/00
(52) U.S. Cl. ..... 114/345; 441/66; 441/130
(58) Field of Search ..... 114/345; 441/38, 441/40, 65, 66, 130

(56) References Cited

U.S. PATENT DOCUMENTS

| | | | | |
|---|---|---|---|---|
| 4,151,620 A | | 5/1979 | Heuzonter | |
| 4,894,033 A | | 1/1990 | Chang | |
| 5,090,930 A | | 2/1992 | Walden | |
| 5,485,981 A | | 1/1996 | Lindahl | |
| 5,713,773 A | * | 2/1998 | Churchil | 114/345 |
| 6,010,381 A | * | 1/2000 | Peterson | 114/345 |

* cited by examiner

*Primary Examiner*—Jesus D. Sotelo
(74) *Attorney, Agent, or Firm*—Dean W. Russell; Kilpatrick Stockton LLP

(57) ABSTRACT

Deflectors for inflatabe watercraft or other objects are disclosed. The deflectors themselves may be inflatable and distinct from the crafts to which they are attached. They thus may be used to increase the height of the crafts without changing the dimensions of the tubes from which the crafts are formed or diminishing the cockpit space available within the crafts.

9 Claims, 1 Drawing Sheet

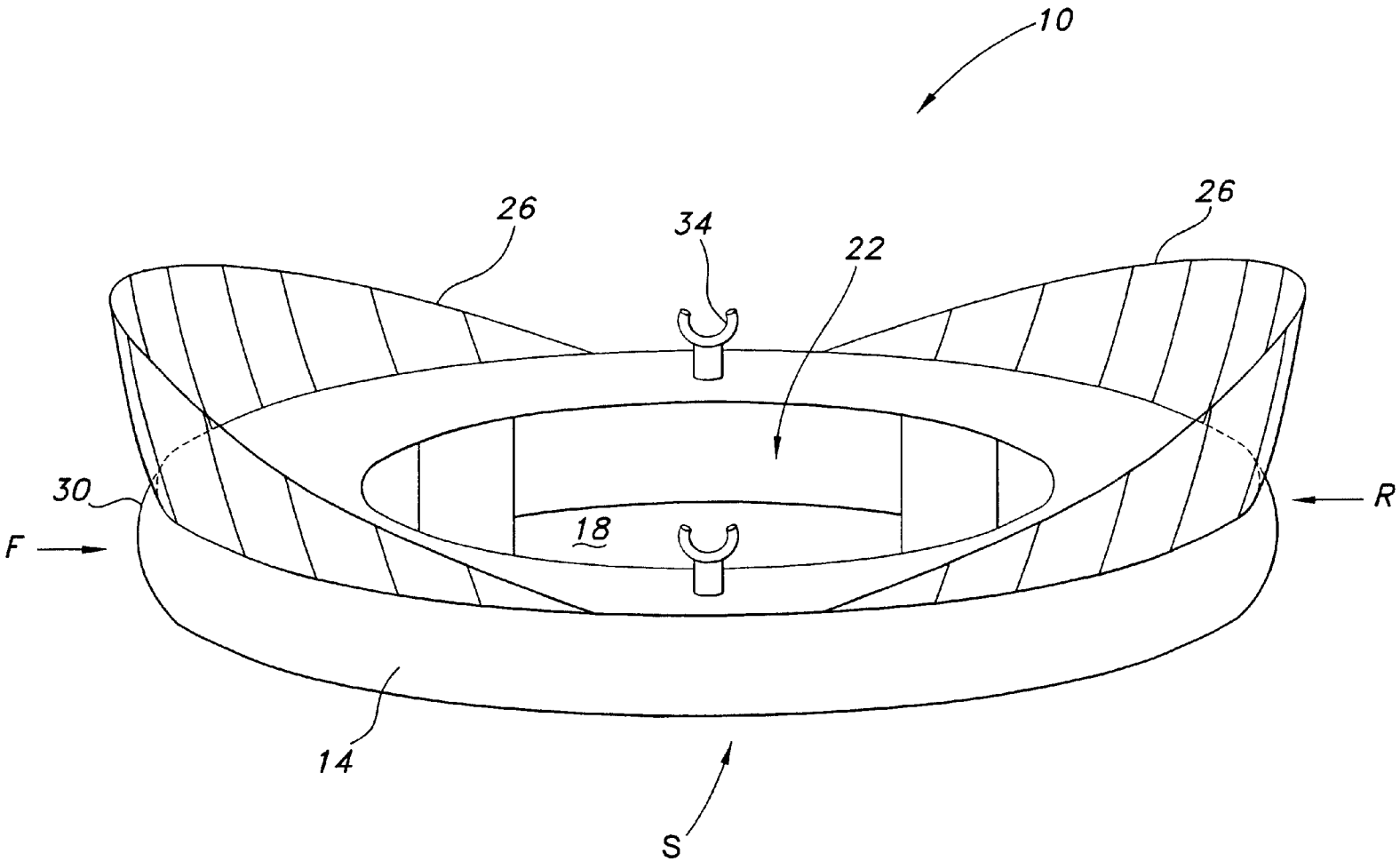
FIGURE

INFLATABLE DEFLECTOR

REFERENCE TO PROVISIONAL APPLICATION

This application is a continuation of U.S. Ser. No. 09/640,324 filed on Aug. 16, 2000 which is based on and hereby refers to U.S. Provisional Patent Application Serial No. 60/149,154 filed on Aug. 16, 1999, both applications having the same title as appears above.

FIELD OF THE INVENTION

This invention relates to inflatable watercraft and more particularly, although not exclusively, to such watercraft having wave deflectors associated therewith.

BACKGROUND OF THE INVENTION

Existing inflatable watercraft, including towable craft, typically include one or more inflatable tubes to which a base or bottom is secured. Often made of PVC, the tubes and base may be connected via radio-frequency welding or any other suitable attachment method. The portion of the base between the tubes, described herein as the "cockpit space," defines the area in which humans may stand, kneel, or sit and be supported above the waterline.

Conventionally, the overall height of the inflatable watercraft is merely the height of its tubes. Because the tubes usually are substantially smaller than the height of a person, even when the person is sitting in the craft, his or her body may have a portion exposed to the elements and thus subjected to unwanted contact with wind, water, or debris as the craft moves through the water. Increasing the height of the tubes is rarely commercially practical, however, as doing so necessarily increases their diameter, in turn undesirably increasing the overall length and width of the craft. Maintaining the same craft length and width while increasing the height of the tubes, alternatively, will decrease the cockpit space, yet another undesirable result.

SUMMARY OF THE INVENTION

The present invention avoids this problem by providing a separate windshield or similar device for deflecting wind, water, and debris. Such a deflector, which may be attached to the upper surface of the tubes of an inflatable watercraft, likewise may be inflatable using one or more valves and made of material such as (but not necessarily) PVC. It thus may be used to increase the height of the craft without changing the dimensions of its tubes or diminishing the available cockpit space associated therewith.

In some embodiments of the deflector of the invention, internal horizontal or vertical I-beams may be used to enhance its strength and rigidity. Those skilled in the art will recognize that other strength-enhancing techniques may be employed, however, as appropriate or desired. Likewise, the deflector may be attached to the tubes of the craft in any suitable manner, including (but not limited to) being tied or fastened thereto. Typically, however, the deflector may be removable from the tubes for transport to or from a body of water or for storage.

Deflectors of the present invention may themselves consist of tubes and be configured similar to the tubes of the crafts with which they correspond. Equally likely, however, they may be semi-circular or -elliptical and have varying height, resembling backrests and integral arms of certain contoured chairs. In these latter configurations, the deflectors have their greatest height at the front (and perhaps the rear as well) of the crafts, with their minimum height along the sides thereof. As so configured, they not only may shield persons within the crafts from wind, water, and debris, but also permit them to see outside the crafts along the sides.

It thus is an object of the present invention to increase the effective heights of inflatable devices such as watercraft.

It is also an object of the present invention to provide inflatable devices whose heights can be increased without increasing the size of the tubes from which they are formed.

It is an additional object of the present invention to provide inflatable devices having a separate windshield or deflector adapted to be attached to the upper surfaces of the tubes of a watercraft.

It is a further object of the present invention to provide deflectors for inflatable craft whose heights vary along their lengths, with the maximum heights being at or near at least the front of the craft.

Other objects, features, and advantages of the present invention will be apparent with reference to the remainder of the text and the drawings of this application.

BRIEF DESCRIPTION OF THE DRAWING

The FIGURE is a perspective sketch of an exemplary inflatable watercraft showing an exemplary configuration of deflectors of the present invention.

DETAILED DESCRIPTION

Shown in the FIGURE is an inflatable device 10 formed of one or more tubes 14 to which base 18 has been permanently connected. Device 10 may be a "towable" craft adapted to be towed behind a motorboat. It alternatively may be a ring or other product used simply to support a person above the waterline for fun or pleasure (although not usually, if ever, for livesaving), with the portion of base 18 between tubes 14 defining the available cockpit space 22 in which the person may stand, kneel, or sit.

Also detailed in the FIGURE are two inflatable deflectors 26, each of which is attached to upper surface 30 of tubes 14. Deflectors 26 thus increase the effective height of device 10 without increasing the dimensions of tube 14 or decreasing cockpit space 22. Attachment of deflectors 26 to upper surface 30 may occur in any appropriate way, including by tying them together (in which case deflectors 26 and tubes 14 may have grommets or other fittings to facilitate the tying) or using complementary fasteners on each of the deflectors 26 and tubes 14. The attachment often is temporary, permitting detachment of deflectors 26 to facilitate transport and storage of device 10.

In the embodiment of device 10 illustrated in the FIGURE, a separate deflector 26 is attached at each of the front F and rear R of the device 10. Greater or fewer deflectors 26 may be used instead, however, as necessary or desired. Likewise, although the FIGURE shows each deflector 26 as being semi-elliptically configured, such configuration is not critical to the invention and may differ as appropriate.

Preferably, however, deflector 26 is internally reinforced for enhanced strength and rigidity when inflated. Such reinforcement may occur through use of horizontally- or vertically-oriented I-beams, although other mechanisms may be employed instead. Deflector 26 additionally may have a height which varies along its length, providing maximum height at front F (or rear R) of device 10 and minimum height at sides S thereof. If made in this way, the deflector 26 can furnish substantial protection from wind, water, and debris without completely inhibiting the sightline of a person sitting or kneeling in device 10.

Deflector 26 may, of course, have dimensions differing from those of the versions depicted in the FIGURE. Device 10 further may differ from the exemplary version of the FIGURE, including or omitting numerous components such as, but not limited to, oarlocks 34. Thus, although the foregoing has been provided for purposes of illustrating, explaining, and describing embodiments of the present invention. further modifications and adaptations to these embodiments will be apparent to those skilled in the art and may be made without departing from the scope or spirit of the invention.

What is claimed is:

1. Inflatable craft defining (i) a forward edge and (ii) a cockpit rearward of the forward edge, the cockpit comprising an open space adapted to support a person, the craft comprising:

a. at least one inflatable component having an edge forming a boundary of the cockpit; and b. at least one inflatable deflector directly or indirectly attached to the at least one inflatable component intermediate the forward edge and the cockpit so as (i) not to extend beyond the edge of the at least one ingatable component and thus (ii) not to protrude into the open space of the cockpit.

2. Inflatable craft according to claim 1 in which the at least one inflatable component is inflatable separately from the at least one deflector.

3. Inflatable craft according to claim 1 in which the at least one inflatable deflector is removable from the at least one inflatable component.

4. Inflatable craft according to claim 1 in which the inflatable deflector is a wind shield.

5. Inflatable craft according to claim 1 in which the inflatable deflector is a wave shield.

6. Inflatable craft according to claim 1 in which the at least one inflatable deflector is semi-elliptically configured.

7. Inflatable craft according to claim 1 further comprising at least one other inflatable deflector directly or indirectly attached to the at least one inflatable component rearward of the cockpit, the inflatable deflectors being configured identically.

8. Inflatable craft defining (i) a forward edge and (ii) a cockpit rearward of the forward edge, the cockpit comprising an open space adapted to support a person, the craft comprising:

a. at least one inflatable component having an edge forming a boundary of the cockpit; and b. at least one inflatable wind shield directly or indirectly attached to the at least one inflatable component intermediate the forward edge and the cockpit so as (i) not to extend beyond the edge of the at least one inflatable component and thus (ii) not to protrude into the open space of the cockpit, the at least one wind shield being inflatable separately from the at least one inflatable component.

9. Inflatable craft defining (i) a forward edge and (ii) a cockpit rearward of the forward edge, the cockpit comprising an open space adapted to support a person, the craft comprising:

a. at least one inflatable component having an edge forming a boundary of the cockpit, and b. at least one inflatable deflector integrally formed with the at least one inflatable component intermediate the forward edge and the cockpit so as (i) not to extend beyond the edge of the at least one inflatable component and thus (ii) not to protrude into the open space of the cockpit.

* * * * *